United States Patent [19]

Brown

[11] 4,232,724

[45] Nov. 11, 1980

[54] MODULAR PARTITION

[75] Inventor: Mortimer Brown, Terra Cotta, Canada

[73] Assignee: Nightingale Industries Limited, Toronto, Canada

[21] Appl. No.: 953,870

[22] Filed: Oct. 23, 1978

Related U.S. Application Data

[63] Continuation-in-part of Ser. No. 745,001, Nov. 26, 1976, abandoned.

[51] Int. Cl.[2] ..... A47G 5/00

[52] U.S. Cl. ..... 160/135; 160/229 R; 160/231 A

[58] Field of Search ..... 160/135, 183, 229 R, 160/231 R, 231 A, 232, 351; 52/36, 239, 282; 211/189, 199; 16/150

[56] References Cited

U.S. PATENT DOCUMENTS

| | | | |
|---|---|---|---|
| 2,882,564 | 4/1959 | Couse et al. | 52/282 |
| 2,918,708 | 12/1959 | Sharp et al. | 160/381 |
| 3,049,195 | 8/1962 | Leat et al. | 52/282 |
| 3,297,077 | 1/1967 | Garbus | 160/231 A |
| 3,324,930 | 6/1967 | Colombo | 160/231 R |
| 3,441,975 | 5/1969 | Shepherd | 16/150 |
| 3,516,114 | 6/1970 | Joyce | 16/150 |
| 3,592,289 | 7/1971 | Aysta | 160/135 |
| 3,695,330 | 10/1972 | Hasbrouck | 160/135 |
| 3,696,855 | 10/1972 | Kira | 160/135 |
| 3,788,378 | 1/1974 | Sobel | 160/135 |

*Primary Examiner*—Peter M. Caun

*Attorney, Agent, or Firm*—George A. Rolston; William F. Frank

[57] ABSTRACT

A partition system having partition panels each of which is provided with one or a pair of outwardly directed connector grooves extending vertically from top to bottom of the panes at each end. Each groove is provided with a narrow open mouth and an enlarged interior. The narrow open mouth portion of each groove is oriented so that it is directed at an outward angle with respect to the end of the panel so that the pair of grooves are arranged in an essentially divergent manner. A connection member consisting of a continuous plastic extrusion is provided having a central web portion, and enlarged bulbous rib members extending down either end of the web, the rib members having a shape essentially the same as the cross-section of the connector grooves, and being adapted to be received within the grooves of two adjacent partition panels, whereby the panels may be joined together edge to edge, along either corner of an end of said panels.

7 Claims, 8 Drawing Figures

MODULAR PARTITION

This application is a continuation-in-part of application Ser. No. 745,001, filed Nov. 26, 1976, entitled Modular Partition, now abandoned.

The invention relates to a partition system for dividing up commercial or office space which is free standing and may be moved from place to place at will.

BACKGROUND OF THE INVENTION

Office partition systems such as have been available in the past, have usually involved a series of partition panels which are supported between the floor and interior ceiling of a building or space. Such systems must necessarily be fastened in position, and are intended as far as possible to simulate regular dry wall construction.

These types of partition systems are relatively expensive and are of a semi permanent nature since it requires a fair amount of labour to move them from place to place.

In order to overcome these disadvantages, interior planners have adopted the use of free standing screens. Such screens will usually be of semi sound proof construction, and will consist of rectangular panels mounted on feet which will support the screen by itself. Three or four such screens may be arranged in a rectangular manner to enclose a working area. The advantage of this system is that the interior space may readily be rearranged simply by lifting up the screens and moving them from place to place. However, such free standing screens leave something to be desired from the view point of privacy. They are usually not connected with one another, and consequently any slight movement will open up a gap between adjacent screens which may be inconvenient.

In addition, such screens are not usually capable of supporting any accessories such as shelving, electrical wiring and lighting.

Some proposals have been made in the past for linking such screens together but such systems as have been available have been somewhat inconvenient, and have not entirely solved the problem of the lack of privacy. In addition, even when linked together, such screens systems did not generally speaking increase the rigidity of the separate screen panels. Thus it was generally speaking still necessary for such screens, even when linked together to be provided with self supporting feet since otherwise they would not remain upright. The dimensions and shaping of the feet necessary to support the individual screens somewhat intruded upon the space enclosed by the screens. Movement of persons, or furniture within the space enclosed might well be obstructed by the location of the supporting feet, with consequent inconvenience.

BRIEF SUMMARY OF THE INVENTION

The invention therefore seeks to provide a free standing partition system which overcomes the disadvantages outlined above, by the provision of a partition system having partition panels each of which is provided with one or a pair of outwardly directed connector grooves extending vertically from top to bottom of the panels at each end. Each groove is provided with a narrow open mouth and an enlarged smooth cylindrical interior. The narrow open mouth portion of each groove is oriented so that it is directed at an outward angle with respect the end of the panel so that the pair of grooves are arranged in an essentially divergent manner. A connection member consisting of a continuous substantially stiff plastic extrusion is provided having a central web portion and enlarged bulbous rib members extending down either end of the web, the rib members having a smooth cylindrical shape essentially the same as the cross section of the connector grooves, and being adapted to be received within the grooves of two adjacent partition panels, whereby the panels may be joined together edge to edge, along either corner of an end of said panels.

In accordance with the invention the connector extrusion is formed with the web portion off set with respect to the bulbous rib members where by to permit the connector member to be used in two alternate positions.

In accordance with the invention the pair of connector grooves are provided by means of a single extrusion of any suitable material such as aluminium or plastic or the like which may be fitted on each end of the panels and extends from top to bottom of each end thereof.

In accordance with the invention such an end extrusion may also incorporate a means for connecting supporting legs on the lower side of the panel, and may also include some form of attachment means for attachment of other accessories such as tables, shelving and the like.

In accordance with a further feature of the invention, there is preferably provided along the lower edge of each panel a pair of base plates, the plates being attached to either side of the panel, and defining conduit spaces therealong with closure plates, beneath the lower edge of the panel, such spaces being adapted for the reception of electrical cables and the like.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

IN THE DRAWINGS

DESCRIPTION OF A SPECIFIC EMBODIMENT

Figures 1, 2:
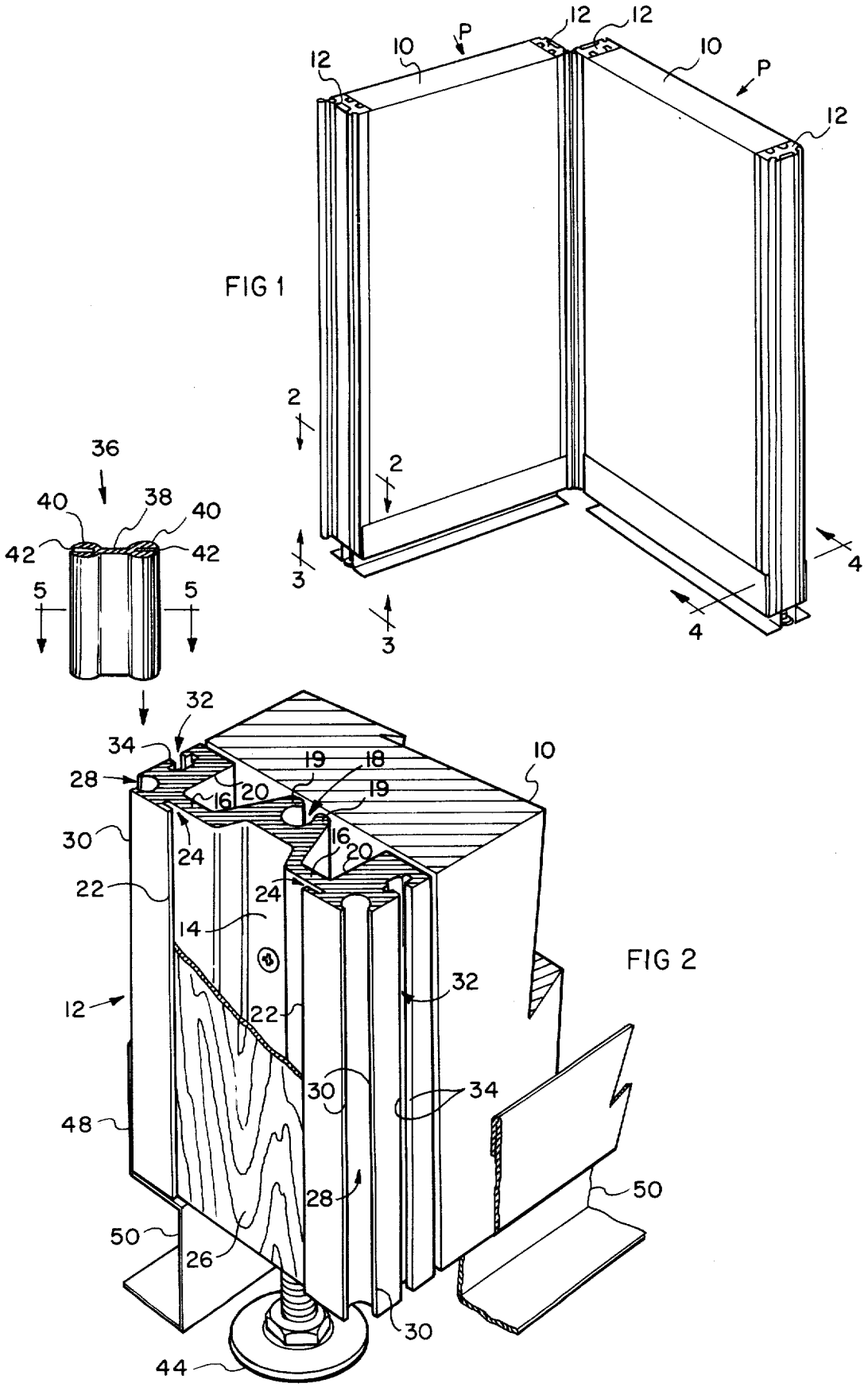
FIG. 1 is a perspective illustration showing two panels according to the invention joined together.
FIG. 2 is a greatly enlarged cut away perspective view indicating that portion of a panel as shown at the section line 2—2 of FIG. 1, with the connecting extrusion shown in an exploded manner.

Referring now to FIG. 1, it will be seen that this preferred embodiment of the invention is shown as two panel members indicated by the general reference arrow P. It will of course be appreciated that there may be more such panels P, and that they may be arranged in various different configurations other than that shown in FIG. 1, FIG. 1 being purely illustrative and without limitation. Each of such panels P will be essentially of the same construction although conceivably some panels may be made larger than others, and their dimensions may vary in height or width or thickness depending upon the requirement of any specific customer. Conceivably, the panels may be made in two or three different widths so as to provide for greater flexibility in the use of the office space area to be divided up. Again, such features are to be understood as included within the scope of the invention, although not specifically illustrated.

Each of such panels P will therefore comprise a generally rectangular central partition portion 10, and two vertical end connector members 12. The end connector members 12 are all of identical construction, in this preferred embodiment of the invention to achieve maximum economy and simplicity in manufacture. However, conceivably variations may be made between the end connector members 12 as between one end and the other of any panel P. For example, right and left handed end connector members 12 could conceivably be constructed which were of a different construction in that the one was a mirror image of the other. In certain circumstances, such a construction might provide for a more limited degree of flexibility in use, but might possibly be acceptable to certain customers or in certain specialized applications.

The construction of the partition portions 10 is not critical to the objects of the invention. In general however such partition portions 10 will be built up on some form of rigid frame work (not shown) which in turn supports any suitable sound baffling media such as fibre glass matting and the like, or any other material which is well known in the art for the purpose. The frame work and filler will be covered by any suitable material such as upholstery material or the like to provide an attractive and decorative appearance.

As shown in more detail in FIG. 2, the end connector members 12 are in this embodiment of the invention formed by a continuous extrusion of any suitable material, in this case aluminum. Other extrudable materials such as thermoplastics or the like may be suitable for specific applications. The extrusion will be seen to provide a central recessed channel 14 having web like extensions 16 extending out from either side thereof, and a semi-cylindrical groove 18 formed by inner walls 19 on its inwardly directed side.

Connected to the outer ends of the two webs 16, there are outer wall members 20 which have flat interior surfaces enclosing the space on either side of the groove 18. Outer walls 20 and inner walls 19, enclosing the groove 18, all terminate in a common plane whereby the same may fit flat against the end surface of the partition member 10 as shown in FIG. 2.

A relatively thin facing flange 22 is formed in an essentially L-shaped manner overlying exterior surfaces of side portions of the two webs 16 thereby defining narrow slots 24 facing one another in a common plane for the reception of a decorative cover strip 26 which may be slid in and out of the slots 24.

On the exterior of the walls 20, there are provided a pair of outwardly angled connector grooves 28 defined by continuous angled wall members 30 extending down either side thereof. Wall members 30 are curved towards one another so that they are closer together at their free ends, than along the interior of the groove 28, thereby defining a groove mouth which is somewhat narrower that the smooth cylindrical interior of the groove 28. The grooves 28 are directed in an outwardly divergent manner at angles of approximately 45° with respect to the longitudinal plane of the panel P for reasons to be described below.

In addition, walls 20 are further formed with rectangular slotted channels 32 the openings of which are enclosed by side flange members 32 to provide an enlarged rectangular interior and a narrow slotted opening for the channels 32.

The channels 32 are directed in opposite directions to one another along a plane normal to the plane of the central axis of the panel P.

In order to connect any two panels P together, a connector hinge strip 36 is provided for sliding down any two adjacent grooves 28 of any two adjacent partitions P and linking them together. The connector strip comprises a relatively thin central web 38, and two bulbous rib portions 40. The bulbous rib portions 40 are designed to fit snugly within the grooves 28. The rib members 40 are of essentially smooth cylindrical construction, and have a narrow slotted opening extending down the length thereof. The exterior cylindrical dimensions of the bulbous members 40 may be slightly in excess of the interior dimensions of the grooves 38. The material from which the connector strip 36 is made will be extrudable thermo plastic material which is fairly rigid. The rib members 40 may be made slightly resilient or flexible by the slotted openings 42 so that they may be squeezed slightly to fit within the grooves 28. In this way there is a certain degree of frictional grip between the connector strip 36 and the grooves 28 into which they are fitted. Preferably, the connector strips 36 will be of a length equal to the height of the panel P so that panels P are connected completely from top to bottom with the exception of a small space at the bottom to be described below.

Figure 5:
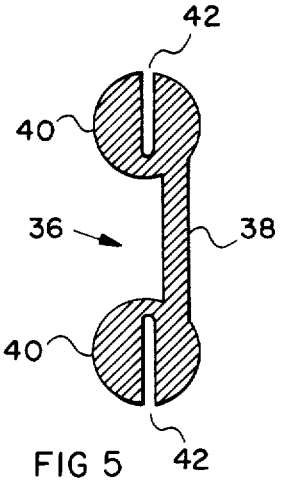
FIG. 5 is a section along the line 5—5 of FIG. 2.
Figure 6:
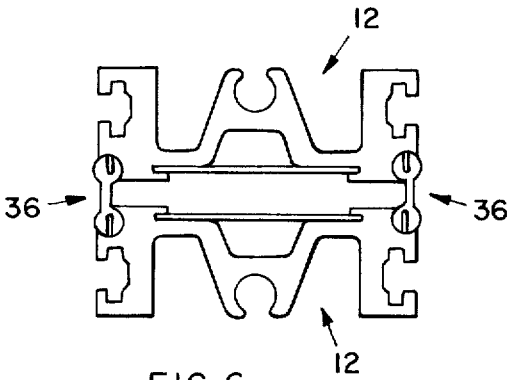
FIGS. 6 and 7 are schematic illustrations showing two different positions of the connection element, and, FIG. 8 is a perspective of an alternate embodiment of the invention.
Figure 7:
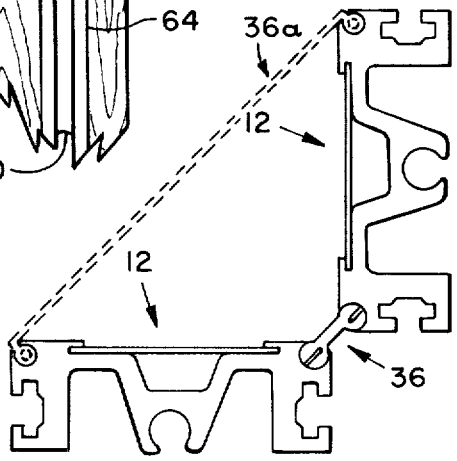

In accordance with a further feature of the invention, the web 38 is assymetrically offset into a different plane with respect to the centres of the rib members 40 as best shown in FIG. 5. This feature permits the connector strips 36 to be used either in a right or left handed manner as best shown in FIGS. 6 and 7. In this way, the connector strips 36 may be used and rotated through an angle of 45 degrees, or even in fact through an angle of 180° if this should be required without the web 38 being required to flex or bend, and which in fact remains flat and unstressed. In this way two adjacent joined panels P become mutually self-supporting, through the intercommection of web 38.

One such connector strip 36 may be used as shown in FIG. 7 for joining two panels P at right angles to one another. Two such connector strips 36 may be used as shown in FIG. 6 for joining two panel members P in a straight line in end to end abutting relationship. This of course greatly increases the rigidity of the junction between such panels P. This feature is of special value when it is born in mind that, when joined end to end in line as shown in FIG. 6 the degree of self support provided between any such panels P is considerably less than when they form a right angle.

Figure 3:
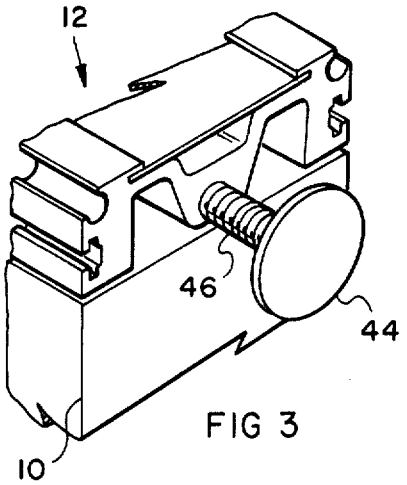
FIG. 3 is a lower perspective illustration of a detail of the invention as shown in FIG. 1 showing the supporting leg feature.

As shown in FIG. 3, the panels P will be supported on legs 44 having an adjustable threaded portion 46 which is threadedly received in suitable female threads (not shown) formed in the interior of the groove 18 of the end connectors 12. It will of course be seen that the legs 44 merely offer support for the actual weight of the panel P and do not in effect stabilize the panel P against tilting over. The relatively small size of the legs 44 as compared with the relatively large feet of the previously known free standing partition systems, is one of the advantages achieved by the invention, leading to greater utilization of the space enclosed by such panels P while at the same time enjoying greater stability through the connector members 36.

The slotted channels 32 may be employed in conjunction with any of a variety of different forms of accessories such as tables, shelving and the like (not shown).

Such accessories may be attached in known manner by inserting a threaded fastening member such as a nut (not shown) in the rectangular channel 32, and inserting any suitable threaded fastener (not shown), such as a bolt, into the nut, the bolt being then attached to a suitable point on a shelf or table and being tightened up. Such connection systems are essentially well known in the art and require no further description. Similarly, shelf supporting brackets may also be attached to such channels 32 in the same way to provide a completely self-supported shelf or table or other accessory.

Figure 4:
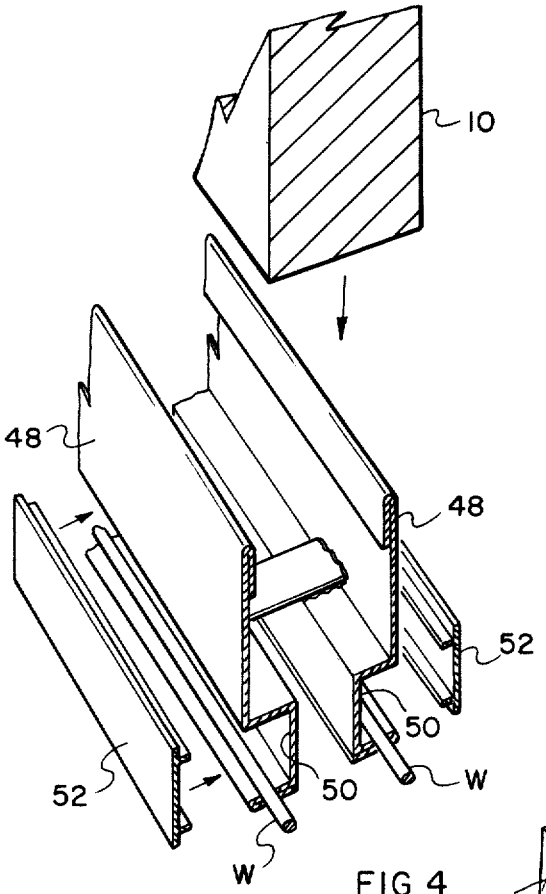
FIG. 4 is an exploded perspective illustration showing the base plate and conduit features of the invention.

In accordance with a further feature of the invention, provision may be made for enclosed wiring conduits in conjunction with the panels P. Such a conduit is shown in more detail in FIG. 4. It will be seen to comprise two identical base plate members 48 which may be attached along the lower edges of the panels P. Each plate 48 is formed with an indented channel portion 50 which is adapted to underlie the lower edges of the panels P. The space within channels 50 is enclosed by removable cover plates 52. The channels 50 will receive any suitable wiring shown as W. Electrical receptacles may be located on the cover plate 52, in suitable openings therein and connected with the wiring in any conventional manner.

For example, the plates 52 may be formed with any suitable clip devices for snapping directly in to the channels 50. Such clip devices will be readily apparent to persons skilled in the art and require no further description.

However, if the purchaser does not required the electrical conduit function, then the plates 52 can be omitted altogether.

In operation, the use of the invention is essentially self evident.

Two panels 10 will be placed in position with their end connectors 12 adjacent to one another. A hinge strip 36 is then lifted so that one end of the strip can be placed at the upper ends of the two adjacent end connector members. The two ribs 40 of the hinge strip 36 are then introduced into respective connector grooves on respective end connector members. The strip 36 is then progressively fed downwardly in a telescopic manner until it extends substantially from top to bottom of both end connector members. The frictional effect provided by the resilience of the ribs 40 and the grooves 42 is sufficient to retain the hinge strip 36 in position so that it will not slide right through the connector members, but will remain where it is placed during all normal usage.

The two panels 10 may then be swung relative to one another to position them in the most desirable location. Alternatively, this may have already been done before the hinge strip 36 is introduced.

If it is desired to swing the panels 10 into a substantially different angular orientation, it may be necessary to withdraw the hinge strip 36, and to introduce it in a reverse manner so that the web 38 is on the other side.

Where it is desired to link the panels 10 to form a continuous straight wall portion, with the panels 10 linked end to end, then two such rib members 36 may be introduced on opposite sides of the panel 10 in essentially the same manner.

The legs 46 may be adjusted up or down so as to bring the top edges of the panels 10 into alignment.

If it is desired to add any shelves or other attachments, this can be done at any time by simply introducing the appropriate threaded nuts into the channels 32 and then fastening a suitable threaded fastener in any known manner.

The electrical wiring such as W may be run around the channels 50 at any time, and the closure plates 52 may be snapped in place or removed at will.

Thus the system is completely flexible and may be used and reused in many different locations and in many different arrangements. At all times, the continuous hinge strips 36 close the gaps between adjacent panels 10 and therefore provide substantially complete privacy within any space enclosed.

At the same time, a system of panels 10 interconnected by hinge strips 36 provides much greater strength and rigidity, while at the same time leaving a clearer working space, free of the relatively large feet which were customary on free standing partitions.

The extrusions 36 may be made in various widths. For example extrusion **36*a* (FIG. 7) may be used to cover the exterior of a junction between two panels 10 at right angles. Similarly, where three panels 10 are joined to form a T-shape, then a similar extrusion 36*a*** of slightly reduced width may cover the rectangular recess which will be formed at such a junction. It will also contribute to the ridigity of the junction.

Alternatively other extrusions having a different shape, for reasons of taste or decoration could be used at these locations. Aluminum junction or corner pieces could be extruded having suitable grooves which could be connected with extrusions 36 as desired, for the same purpose of filling in or covering exposed corners.

Figure 8:
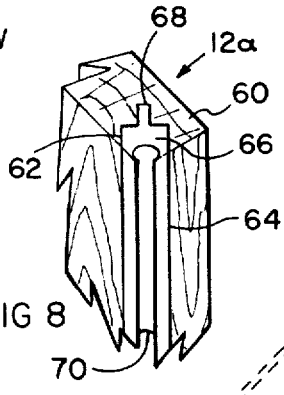

In accordance with a further embodiment of the invention, the vertical end connector members 12 may be of composite construction, as shown in FIG. 8, where a combination of wood and plastic is illustrated. The end connector **12*a* as shown in FIG. 8 will be seen to comprise a wooden trim strip 60, of essentially the same width as the overall width of the end connector 12. The wooden trim strip 60 will be applied at each end of the partition panel 10, in essentially the same manner as is shown in FIG. 2. It will be provided at each of its outwardly directed corners with a generally rectangularly shaped channel or groove 62 cut into the wood, and angled outwardly at 45°. Within the grooves 62, there is provided a continuous extruded thermoplastic corner strip 64. The corner strip 64 will be seen to comprise a main body portion 66, and an inwardly directed anchor strip 68. At its outwardly directed corner, it is provided with a channel 70, similar to the channel 32 of the end connectors 12. In use, it is used in essentially the same way as the end connector 12**.

If it is desired to attach accessories such as shelves, tables, and the like to the partition member using the end connectors **12*a* of FIG. 8, it will be seen that no provision is made corresponding to the slotted channels 32 of the end connector 12. In their place, some other form of adjustable shelf attachment may be provided. Typically it may take the form of any well known form of slotted metal channel (not shown) which may be attached to the wooden strip 12, or located in a suitable groove which may be routed out from the wooden strip 12**. However, the details are essentially obvious and well known to persons skilled in the art and require no further description.

It will of course be appreciated that the thermoplastic strips 64 will be fastened in the grooves 62 by means of suitable adhesive. The particular type of adhesive used will be dependent at least in part on the nature of the thermoplastic used for the strips 64. The choice of such adhesives is therefore a matter of design and requires no description. The purpose of the anchor strips 68 is to provide greater surface for such adhesives to engage thereby increasing the strength of the bond between the thermoplastic and the wood.

One of the advantages of using the invention in this way, is that the thermoplastic 64 may be extruded in any suitable colour which may match the colouring or staining of the wood strip 60. In addition, the thermoplastic 64, having the colour incorporated in the material itself, may be more resistant to staining, scratching and the like than would extruded aluminum, and may therefore be more desirable for certain circumstances or applications.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A modular partition panel wall of the type in which a panel is adapted to be associated with at least one other such panel to provide a self supporting free standing wall, and comprising at least two said panels, each of said panels having;

a generally rectangular panel body portion having top and bottom edges and upright end edges at each end thereof having front and back faces;

end connector members fastened along each said end edge of said panel extending from top to bottom thereof; and each said connector member having side edges coterminous with said front and back panel faces, and having inner and outer faces;

a median recess formed in said outer face of each said connector member intermediate said side edges for reception of fastening means therein;

panel contact means along each said side edge;

a semi-cylindrical groove along said inner face of said end connector member intermediate said side edges having an open side aligned with said median recess, said panel contact means and said groove terminating in a common plane whereby they lie flat along an adjacent end edge of a said panel;

at least one connector groove formed in each said end connector member extending from top to bottom thereof and defining a smooth cylindrical inner surface and having an open mouth directed at an acute angle relative to the plane of said panel body portion, and, connector hinge strip means having a generally flat planar web portion and smooth cylindrical ribs along either side of said web portion, said rib being connected to said planar web portion in an offset assymetrical manner whereby a plane passing through the centres of both said ribs will lie parrallel to but spaced apart from the plane of said rib, one said rib being shaped to interfit telescopically and rotatably with a said connector groove, in one said end connector member, and the other said rib being shaped to interfit telescopically and rotatably with said connector groove in another said end connector member of a panel adjacent thereto, said ribs being interfitable with said grooves in both left and right handed positions, said web portion extending between said end connector members from top to bottom thereof and providing a continuous flat planar junction between said at least two panels, forming same into a wall as aforesaid.

2. A modular parition panel as claimed in claim 1 wherein said ribs on said hinge strip means are slightly resilient whereby they may be squeezed into a said groove to provide a good frictional fit therein.

3. A modular partition panel as claimed in claim 2 wherein each said rib is formed with a recess therein, said recess permitting flexion of portions of said rib to provide said resiliencey as aforesaid.

4. A modular partition panel as claimed in claim 3 including base plates along the bottom of each side of said panel body portion said base plates defining lengthwise channels extending from one end to the other of said rectangular panel body portion said channels having back walls and top and bottom walls recessed inwardly beneath said panel body portion, and including closure panel means adapted to be releasably fastened over said channel means whereby said channel means may accomodate wiring.

5. A modular partition panel as claimed in claim 1 wherein said end connector members are formed of wooden material, and incorporate channel members made of another material extending from top to bottom of the connector members, and having outwardly directed connector grooves formed therein, and directed at an angle relative to the plane of the body portion as aforesaid.

6. A modular partition panel as claimed in claim 1 including thread means formed in the lower ends of said semi-cylindrical channels, and supporting leg means threadedly received therein for adjustably supporting said panel.

7. A modular partition panel as claimed in claim 6 wherein said end cover panel means comprises continuous strips of thin plastic material of predetermined width, and wherein said attachment means comprise continuous flange members formed on said outer faces of said end connector members, on opposite side edges thereof in registration with one another defining continuous narrow groove formations adapted to receive said strips of plastic material therein.

* * * * *